US008907297B2

(12) United States Patent
Chang

(10) Patent No.: US 8,907,297 B2
(45) Date of Patent: Dec. 9, 2014

(54) MULTI-DIMENSIONAL PHOTOCATHODE SYSTEM

(71) Applicant: FAR-TECH, Inc., San Diego, CA (US)

(72) Inventor: Xiangyun Chang, Miller Place, NY (US)

(73) Assignee: FAR-TECH, Inc., San Diego, CA (US)

( * ) Notice: Subject to any disclaimer, the term of this patent is extended or adjusted under 35 U.S.C. 154(b) by 15 days.

(21) Appl. No.: 13/691,721

(22) Filed: Nov. 30, 2012

(65) Prior Publication Data

US 2014/0152176 A1 Jun. 5, 2014

(51) Int. Cl.
*H01J 29/00* (2006.01)

(52) U.S. Cl.
CPC ..... *H01J 29/00* (2013.01)
USPC ..... 250/396 R

(58) Field of Classification Search
USPC ..... 250/396 R–396 ML
See application file for complete search history.

(56) References Cited

U.S. PATENT DOCUMENTS 6,376,985 B2 * 4/2002 Lee et al. ..... 313/542

* cited by examiner

*Primary Examiner* — Jack Berman
*Assistant Examiner* — Eliza Osenbaugh-Stewart
(74) *Attorney, Agent, or Firm* — Elizabeth Kim Patent Law Offices LLC

(57) ABSTRACT

A photocathode system includes a plurality of photocathodes, and at least one combining device. The photocathodes have individually adjustable voltages, and each photocathode generates an individual electron bunch at an emission period. The combining device combines the individual electron bunches, generated at each emission period, into a combined bunch along a combined axis. The timing of the individual electron bunches is independently adjustable, so that an electron bunch with a lower energy arrives at the combined axis earlier in time compared to another electron bunch with a higher energy, thereby allowing the combined beam of electron bunches to be longitudinally compressed. The photocathodes may be distributed along a 1D column, or a 2D array, or a 3D array, or any arbitrary configuration. A linac is located near a longitudinal focusing point to boost beam energy and therefore freeze bunch length and emittance.

19 Claims, 4 Drawing Sheets

MULTI-DIMENSIONAL PHOTOCATHODE SYSTEM

BACKGROUND

Most modern accelerator-based applications require a high-brightness, high-peak and high-average current electron beam that has a short bunch, a small energy spread, and a long lifetime. This type of beam is often referred to as a "super beam." Photocathodes are typically used to generate such a super beam, because photocathodes have a very high current density capability, compared to thermionic cathodes, and because photocathodes are able to generate short bunched beams that can be matched into RF (radiofrequency) accelerators.

Photocathodes have a limited lifetime, even if operated at ultra-high vacuum (UHV) environments. The main reason is ion-bombardment that occurs during operation. State-of-the-art non-polarized photocathodes can operate at average currents of tens of mA, with a charge lifetime of less than 1000 Coulombs, which is equivalent to a lifetime of less than 28 hours at an average current of 10 mA. State-of-the-art polarized beams can operate at average currents of a few mA with charge lifetime of about 200 Coulombs, which is equivalent to a charge lifetime of less than 6 hours at an average current of 10 mA.

Most modern accelerator projects require electron sources with much higher average currents (with a reasonable operating period), compared to what is provided by the state of the art. In addition, these projects also require low emittance, high-peak currents with short bunch lengths, and small energy spread beams, as required by a super beam.

Apart from charge lifetime issues, many technical challenges remain in developing such a super beam. The requirements of a super beam include a small emission area, a high bunch charge, and a high repetition rate. Also, the beam must be compressed for a short bunch beam. Reducing the emission area and increasing the bunch charge will increase the space charge on the cathode, so that eventually the source becomes space-charge limited.

Attempts to overcome space charge effects on photocathodes include various methods of increasing the electric field gradient on the cathode ($E_{Cth}$), combined with a certain degree of bunch lengthening on the cathode. Methods for pushing up $E_{Cth}$ include without limitation: increasing the anode-cathode voltage or reducing the accelerating gap, when DC voltage guns are used; and using RF cavity guns (also referred to as RF guns) or even superconducting RF guns.

As $E_{Cth}$ is finite, one has to increase the bunch length on the photocathode, to further reduce the space charge effects on cathode, and compress the bunch later on. Increasing bunch length on the photocathode makes the later beam compressing more difficult, however.

Usually the beam bunch is too long after the beam comes out from gun. This requires the beam bunch to be compressed in order to reduce bunch length. Generally, compression techniques include without limitation: ballistic compression techniques, which utilize the velocity difference in a bunch; and "dispersion optics" compression techniques, which utilize the path length difference of a bunch through a beam line.

In ballistic compression, a beam bunch energy distribution is modified by an RF cavity (bunching cavity) such that the head beam energy is lower than the tail beam energy, then the tail beam catches up with the head beam during drifting and eventually the beam is compressed. This technique requires that the beam not be too relativistic, or else the drifting length would be very long. Assume a beam has a center energy of 1 MeV and head-tail energy difference of ±5% (head energy<tail energy), the bunch length can be compressed 8.0 mm per 1 m of drift.

In dispersion optics compression, the beam bunch energy distribution still needs to be modified in the same way as with ballistic compression. The beam then enters a dispersive beam line such as a symmetric magnetic chicane.

FIG. 1 illustrates a symmetric magnetic chicane that can be used in conventional dispersion optics compression. As the head beam with lower energy travels for a longer distance, compared to the distance traveled by a tail beam with higher energy, the bunch is compressed after the beam passes through the chicane.

Chicane compression is generally suitable for relativistic beams. The compression length (Δs) by a magnetic chicane, at small energy spread (δ), is approximately:

$$\Delta s = 2a\theta\frac{\sin\theta}{\cos^2\theta}\delta,$$

where a is the projected distance between the 1st magnet (101) and the 2nd magnet 102 (or between the 3rd magnet 103 and the $4^{th}$ magnet 104), and θ is the bending angle of each dipole. Assuming that a=1 m and θ=30°, the center energy is 5 MeV and the head-tail energy difference is ±1%, which is the same energy magnitude difference compared to the ballistic compression example. The compression length is about 14 mm through the system.

Both ballistic compression and chicane compression will degrade beam emittance and leave a high final energy spread.

Despite past efforts to overcome space-charge effects, including the compression techniques described above, many challenges thus remain.

BRIEF DESCRIPTION OF THE DRAWINGS

The drawings disclose illustrative embodiments. They do not set forth all embodiments. Other embodiments may be used in addition or instead. When the same numeral appears in different drawings, it is intended to refer to the same or like components or steps.

DESCRIPTION

In the present application, methods and systems are disclosed relating to multi-dimensional photocathode systems. Illustrative embodiments are discussed. Other embodiments may be used in addition or instead.

Figure 1:
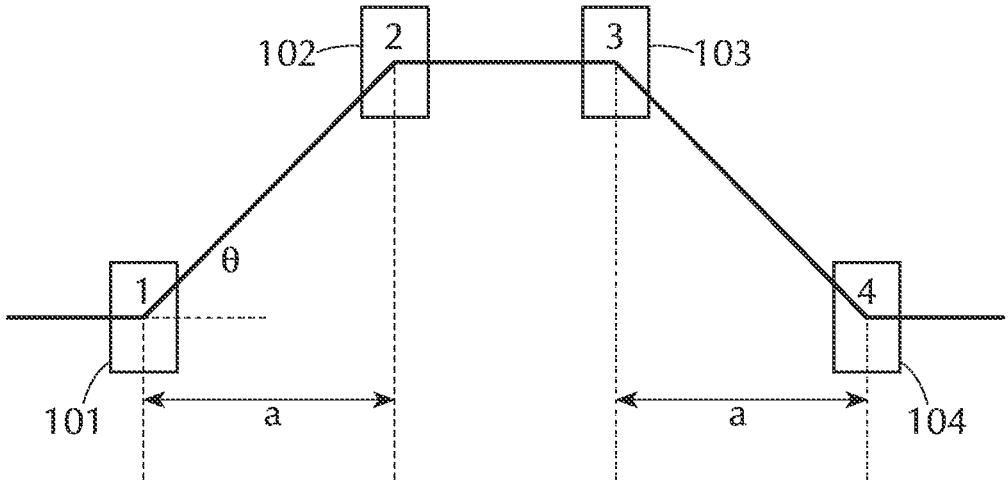
FIG. 1 PRIOR ART
FIG. 1, discussed in the Background Section, illustrates a symmetric magnetic chicane used in conventional dispersion optics compression techniques.
Figure 2:
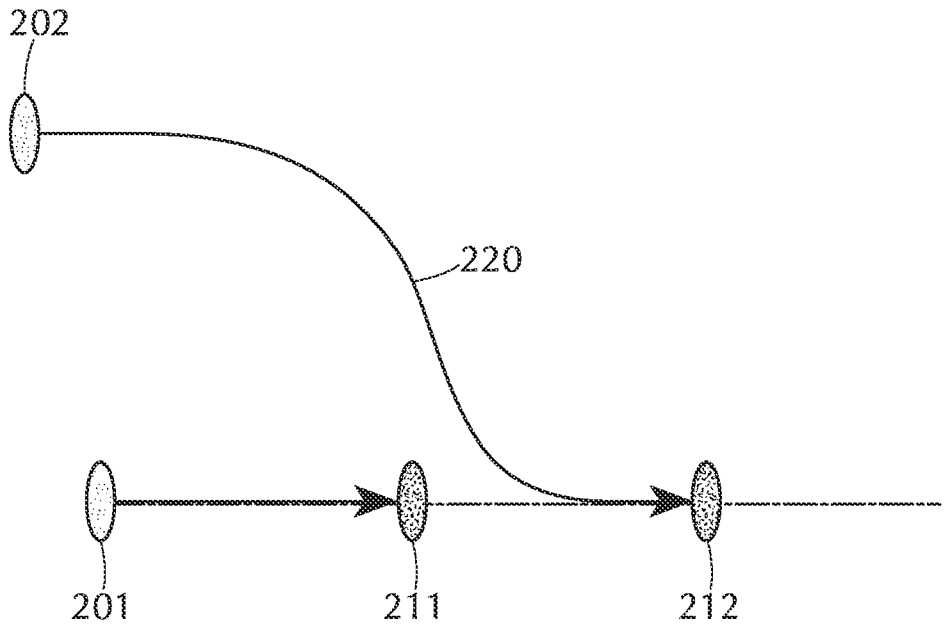
FIG. 2 illustrates two beams, originating at different locations, that are brought to a same axis by linear transport lines, so that their emittances are conserved.

FIG. 2 illustrates one of the principles that the methods and systems disclosed in the present application rely on. In particular, FIG. 2 illustrates how two beams 211 and 212, originating from two different locations 201 and 202, can be brought to a same axis by linear transport lines, and conserve their emittances.

As illustrated in FIG. 2, if multiple beams (indicated in FIG. 2 by reference numerals 211 and 212) originating from different locations (indicated by reference numerals 201 and 202) are combined into a same axis through linear transport lines, and each beam is emittance dominated, then each beam's emittance can be conserved during the combination. Furthermore, if these beams are matched after they are combined, the overall emittance of the combined beam is minimized, and is less than the emittance of the highest emittance individual beam. The term "matched" as used herein means that the densities of each combining bunch are the same, the phase spaces of each combining bunch are concentric, and have the same orientation.

Figure 3:
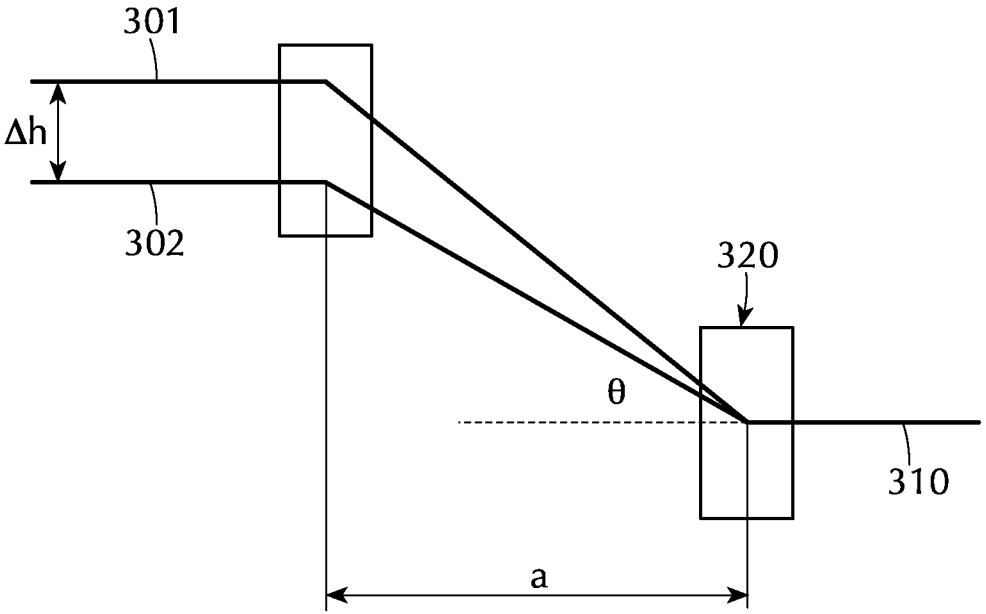
FIG. 3 illustrates the combining of two parallel beams with different energies and different trajectories onto a same axis.

FIG. 3 illustrates another principle that the methods and systems disclosed in the present application rely on. FIG. 3 illustrates how two beams with different energies and different trajectories can be combined into a same axis, without degrading their emittances. As illustrated in FIG. 3, two parallel beams 301 and 302, each having different energies, are combined to a same axis 310, through a final static field component 320. The separation of the beams at the entrance (Δh in FIG. 3) to a static field combining device is approximately:

$$\Delta h \approx \frac{a\theta\delta}{\cos^2\theta}.$$

Assuming that a=1 m, θ=30° and that the energy difference is ±10%, then Δh~14 cm.

Figure 4:
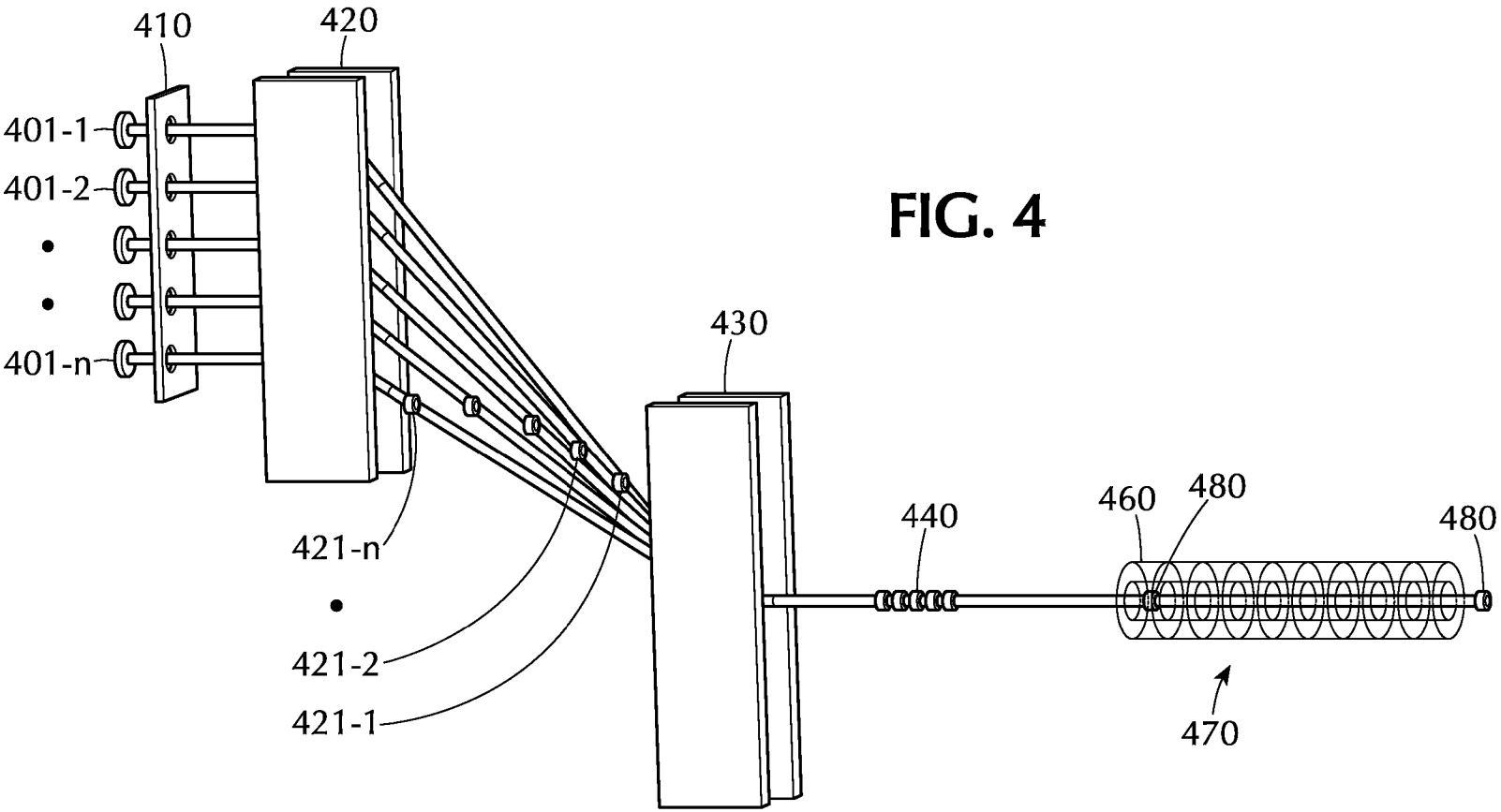
FIG. 4 illustrates a one-dimensional (1D) array photocathode system, in accordance with one or more embodiments of the present application.

FIG. 4 illustrates a 4D photocathode system, in accordance with one or more embodiments of the present disclosure. In the illustrated embodiment, a 1D array photocathode system 400 is shown.

Figure 5:
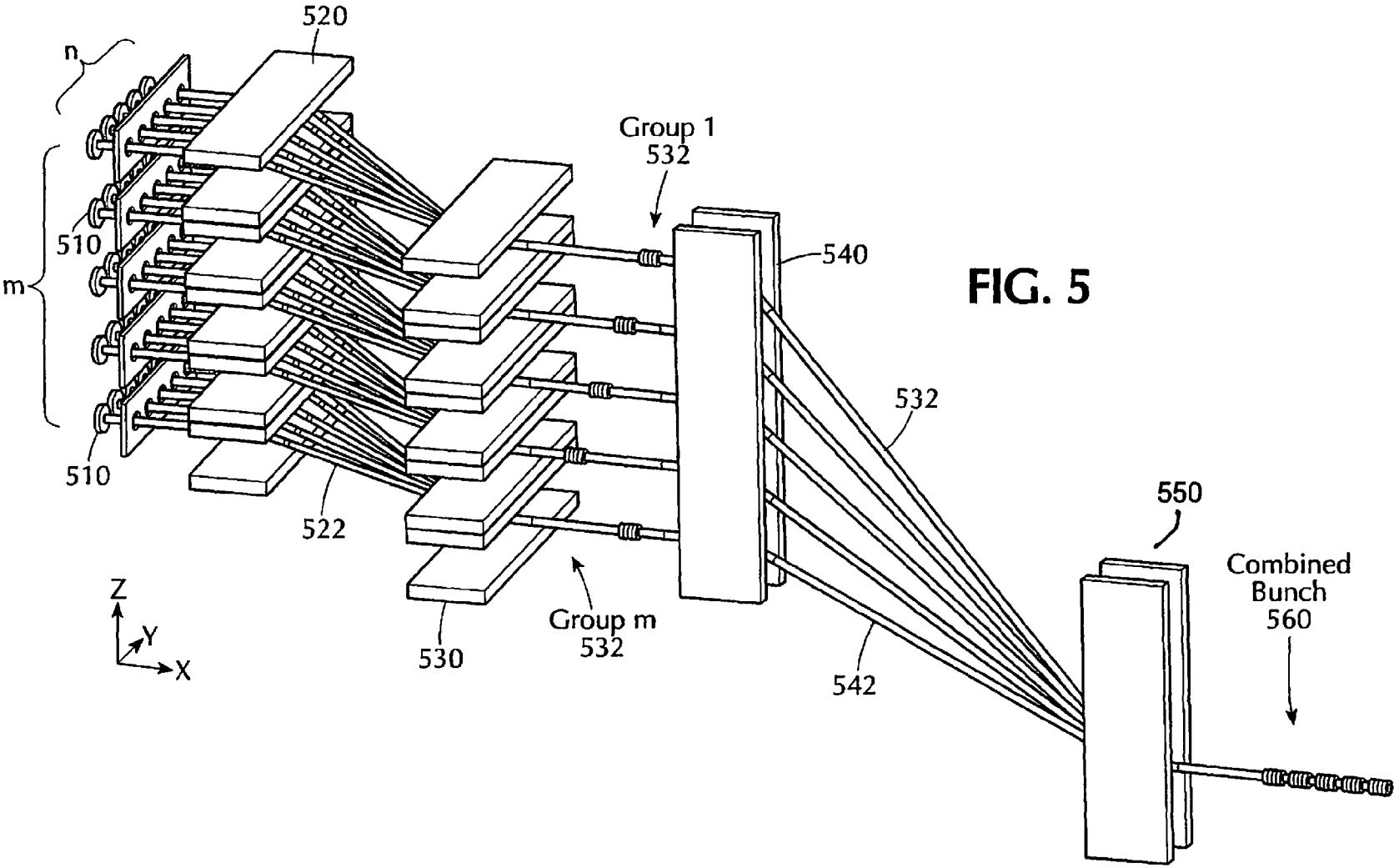
FIG. 5 illustrates a two-dimensional (2D) array photocathode system, in accordance with one or more embodiments of the present application.

In overview, the system 400 includes a plurality n of photocathodes (401-1, 401-2, . . . , 401-n), a corresponding plurality of anodes 410, a static field bending device 420 (illustrated in FIG. 4 with a static magnetic dipole), a static field combining device 430 (illustrated in FIG. 4 with a static field magnetic dipole), and a linac 470. In the illustrated embodiment, the plurality n of photocathodes are evenly distributed on a 1D column. Other embodiments may use photocathodes that are distributed along a two-dimensional (2D) array, as shown in FIG. 5, or a 3D array, or anywhere within an arbitrary 2D or 3D configuration.

In the illustrated embodiment, the photocathodes 401-i (where i is an integer ranging from 1 to n) have independently adjustable voltages. Each one of the plurality of photocathodes 401-i is configured to generate a short electron bunch 421-i, during an emission period.

The timings of each electron bunch 421-i are also independently adjustable. The timings are adjusted such that electron bunches 421-i with a lower energy arrive at a combined beam axis earlier in time, compared to electron bunches with higher energies. The combined bunches 480 and 440 have a fixed delay time between them, i.e. have a repetition frequency that is the inverse of the delay time. Each individual photocathode generates individual electron bunches with the same repetition frequency, but at different phases depend on their energies and locations. A low energy sub-bunch in the combined bunch, such as 421-1 in FIG. 4, may be generated much earlier than the one with high energy, such as 421-n in FIG. 4.

The system 400 has a flexible design, and allows for many variations. In principle, the locations of each photocathode in FIG. 4 do not have to be on a column, they can be anywhere along an arbitrary 3D configuration, as long as the beams are brought together through linear transport lines. As bunch timing, which also must be considered, can be viewed as an additional dimension, the system 400 can be considered a 4D (3D space+1D time) photocathode system.

The individual electron bunches 421-i enter the combining device 430, after which a combined bunch, i.e. a combined beam 440 of bunches that combines the individual electron bunches 421-i generated by the photocathodes 401-i, exits from the combining device 430. The combined bunch 440 is compressed longitudinally due to the energy differences between the individual electron bunches.

A longitudinal focusing point for the electron bunches 421-i is illustrated with reference numeral 460, in FIG. 4. In the illustrated embodiment, the linac 470 is used to boost the energy of the combined beam 440, and is positioned so that its entrance is near the longitudinal focusing point 460. The linac 470 provides a strong acceleration that rapidly freezes the relative longitudinal motion between the electron bunches 421-i and the transverse emittance.

Assuming that the cathode emission areas of each photocathode 401-i in the 1D array system 400 are the same as that of a conventional single cathode system, if all the electron bunches 421-i are matched near point 460 in the 4D system 400, the combined beam emittance will be the same as that of the conventional system, i.e. the same as that of a single-cathode system. This is true even if the total participated emission area in the 4D system 400 is n times larger than that of a conventional photocathode system, as pointed out in conjunction with the principles discussed in conjunction with FIG. 2 and FIG. 3 above.

The matching of 421 near point 460 in the 4D system 400 is possible because there are many spaces in the 4D system where individual bunches are separated, and so allows different optics for different beams.

As there are n times more cathodes in 1D array system 400, compared to conventional single-cathode systems, the bunch charge can be as high as n times the bunch charge of a conventional system. Alternatively, keeping the same bunch charge, the space charge force in system 400 is n times less than that in a conventional system. The beam optics may be designed to let each beam mostly keep a large beam size during the transport but the size is always within the linear range limit, to further reduce the space charge.

Because the energies of each electron bunch 421-i are adjusted such that bunches will self-compress without the necessary of additional energy modification, the bunch length in the system 400 can be very small.

To achieve even shorter final bunches, a number of methods can be used. For example, very short initial bunches on the photocathode can be considered. Alternatively, an AC field may be superposed on an HV field. This makes it possible for the energy of each sub-bunch to be modified, so that each bunch can be self-bunched, thus allowing a long initial bunch length on the cathode.

Alternatively, a bunching cavity may be added, after the bunches are combined. The peak voltage across the bunching cavity gap will be very small, about tens of kV, due to the low bunch center energy. Higher peak voltage across the bunching cavity gap can also be considered.

In the photocathode system 400, the initial energy spread of the combined bunch is typically high, on the order of about ±10%, but the energy difference amplitude (ΔE) is small due to the small center energy ($E_0$). Assuming that $E_0$ is 100 keV, ΔE is only ±10 keV. As the combined bunch 440 is very short during linac acceleration, the energy gain difference in linac ($\Delta E_{acc}$) due to accelerating phase difference is greatly suppressed.

For example, assuming the bunch length is 10 times smaller than that of in a conventional system, $\Delta E_{acc}$ will be about 100 times smaller. The final energy spread due to linac acceleration of different phase will be reduced from about $\pm 1\times 10^{-2}$ of a conventional system to about $\pm 1\times 10^{-4}$. Furthermore, the energy spread introduced in the beginning does not increase the longitudinal emittance very much, due to the energy linearity of the bunches. Unless bunches are completely merged into each other, ΔE can be mostly compensated by linac acceleration. The longitudinal space charge during bunch compressing also helps reduce ΔE.

The charge lifetime of the photocathode system 400, namely the charge extracted when QE drops to 1/e of its initial QE, is increased by n times, compared to the charge lifetime of single photocathode systems. This is because the total participating emission area is expanded n-fold, in the photocathode system 400 illustrated in FIG. 4.

In the 4D photocathode system 400, the bunch compression section of a single photocathode system can be eliminated in the 4D photocathode system, resulting in significant cost savings.

The design flexibility of the system 400 is also shown by its ability to produce a "beer can" distribution beam, an ellipsoid beam, which has optimal beam dynamics properties, and other complicated beam profiles that are very hard to achieve by laser shaping techniques.

Any static magnetic bending components in the above system can also be replaced by static electric bending systems, due to the relatively low electron energy.

The 4D system 400 is highly reliable, because it is mostly composed of electrostatic and electromagnetic components, which are very reliable. These can also be finely adjusted, so that the beam optics, in turn, can be finely adjusted.

The 4D system 400 is applicable to both polarized and non-polarized electron beams.

As noted above, the 1D array photocathode system shown in FIG. 4 can be further expanded to photocathode systems based on 2D or three dimensional 3D arrays or other geometric configurations. FIG. 5 is an example of a 2D array photocathode system.

In embodiment illustrated in FIG. 5, a plurality N of photocathodes 510 are distributed along a 2D array having n rows and m columns, where n and m are chosen so that the total number of photocathodes, N, is equal to n×m. In this embodiment, the final combined bunch 560 is thus composed of n×m bunches. Pairs of horizontal combining components 520 and 530, and two vertical combining components 540 and 550, are shown in FIG. 5. All the bending and combining components in FIG. 5 are illustrated with magnetic dipoles.

With the 2D array configuration illustrated in FIG. 5, it is easier to include a higher number of photocathodes, compared to the number of photocathodes in the 1D array system 400 shown in FIG. 4, thus a higher bunch charge can be obtained.

The separation (horizontal gap) between adjacent photocathodes in each cathode row in FIG. 5, due to the reduction in energy difference, would be m times smaller than the vertical gap between rows, if the combining schemes are all identical. Assuming that the horizontal combining components 520 and 530 and the vertical combining components 540 and 550 have the same structure as shown in FIG. 3, and assuming that m=n=5, the horizontal gap would be only 0.56 cm for peak energy difference of ±10%. The horizontal gap can be increased by methods that include without limitation: increasing the drift length, increasing the bend angle, and increasing energy spread during bending.

The sub-bunches of each group in FIG. 5 may have slight different energies but may enter the vertical combining element 550 in the same position. To overcome chromaticity problems, a transition section (not shown) may be added between the horizontal combining section and the vertical combining section to match them.

In some embodiments, the locations of the photocathodes can be further expanded to arbitrary 3D locations, so that the system becomes a truly four-dimensional photocathode system.

The 4D photocathode system described above can be converted to generate electron bunches with repetition frequency that is higher than laser frequency, by changing the sub-bunch timings. This operation mode of the 4D photocathode system could be used to generate high frequency electron beams and could be used in high power, high frequency klystrons.

In sum, methods and systems have been described relating to multi-dimensional photocathode systems.

The components, steps, features, objects, benefits and advantages that have been disclosed above are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages.

Nothing that has been stated or illustrated is intended to cause a dedication of any component, step, feature, object, benefit, advantage, or equivalent to the public. While particular embodiments of the present application have been described, variations of the present application can be devised without departing from the inventive concepts disclosed in the disclosure.

In the present application, reference to an element in the singular is not intended to mean "one and only one" unless specifically so stated, but rather "one or more." All structural and functional equivalents to the elements of the various embodiments described throughout this disclosure, known or later come to be known to those of ordinary skill in the art, are expressly incorporated herein by reference.

What is claimed is:

1. A photocathode system comprising:

a plurality N of photocathodes, each photocathode configured to generate an individual electron bunch at an emission period; and at least one combining device configured to combine the individual electron bunches, generated at each emission period, into a combined bunch along a combined axis;

wherein timing of the individual electron bunches is independently adjustable, so that an electron bunch with a lower energy arrives at the combined axis earlier in time compared to another electron bunch with a higher energy, thereby allowing the combined beam of electron bunches to be longitudinally compressed.

2. The photocathode system of claim 1, wherein the photocathodes have independently adjustable voltages, and wherein the longitudinal compression of the combined bunch of electron occurs from energy differences between the individual electron bunches.

3. The photocathode system of claim 1, wherein the combining device is configured to bring together the individual electron bunches through linear transport lines so as to combine the individual electron bunches.

4. The photocathode system of claim 1, wherein the combining device is configured to combine one or more static fields at a plurality of locations.

5. The photocathode system of claim 4, wherein the static fields comprise at least one of: a static magnetic field; and a static electric field; and wherein for a static magnetic field, the combining device is a magnetic dipole.

6. The photocathode system of claim 5, wherein the at least one combining device comprises: a vertical combination component and a horizontal combination component and wherein for a static magnetic field, the vertical combination component and the horizontal combination component are magnetic dipoles.

7. The photocathode system of claim 6, further comprising a transition section configured to match the different energies of the electron bunches that enter the vertical combination component at the same position.

8. The photocathode system of claim 1, further comprising a linac configured to provide an acceleration for the electron bunches so as to freeze their relative longitudinal motions and their transverse emittances.

9. The photocathode system of claim 1, wherein the photocathodes are disposed along a 1D (one-dimensional) column.

10. The photocathode system of claim 9, wherein the photocathodes are evenly distributed along the column.

11. The photocathode system of claim 1, further comprising a static field bending component between the plurality of photocathodes and the combining device, the static field bending component configured to bend the individual electron bunches toward the combining device by applying a static field .

12. The photocathode system of claim 11, wherein the static field comprises one of: a static magnetic field; and a static electric field;

wherein for a static magnetic field, the bending component is a magnetic dipole; and wherein for a static electric field, the bending component is a static electric bending system.

13. The photocathode system of claim 1, wherein the energies of each electron bunch are individually adjustable so that the electron bunches self-compress without need for additional energy modification.

14. The photocathode system of claim 1, wherein the electron bunches are matched near a longitudinal focusing point of the combined bunch, so that the emittance of the combined bunch is minimized and is less than the emittance of the highest emittance individual sub-bunch.

15. The photocathode system of claim 1, wherein the N photocathodes are disposed along an n ×m two dimensional (2D) array having n rows and m columns, and wherein N=n ×m.

16. The photocathode system of claim 1, wherein the photocathodes are disposed along a three- dimensional (3D) array.

17. The photocathode system of claim 1 wherein charge lifetime of the system is N times $Q_{TF}$, where $Q_{TF}$ represents the charge lifetime of a single one of the photocathodes and has a value of about 1000 C when electron beams emitted by the photocathodes are non-polarized, and 200 C when electron beams emitted by the photocathodes are polarized.

18. A method comprising:

generating individual electron bunches from each one of a plurality N of photocathodes, at a respective emission period;

combining the individual electron bunches, generated at each emission period, into a combined bunch along a single combined axis; and adjusting the timing of the individual electron bunches, so that an electron bunch with a lower energy arrives at the combined axis earlier in time compared to another electron bunch with a higher energy, thereby allowing the combined beam of electron bunches to be longitudinally compressed.

19. The method of claim 18, wherein the act of combining the individual electron bunches comprises bringing together the individual electron bunches along linear transport lines.

* * * * *